US006855290B2

(12) United States Patent
Castellani

(10) Patent No.: US 6,855,290 B2
(45) Date of Patent: Feb. 15, 2005

(54) DEVICE AND RESPECTIVE EQUIPMENT FOR RECEIVING AND DISCHARGING BARS, USED PARTICULARLY FOR HANDLING AND/OR WRAPPING PURPOSES DOWNSTREAM OF ROLLING-MILLS, AND ITS RESPECTIVE ROLLING-MILL

(75) Inventor: Federico Castellani, Tarcento (IT)

(73) Assignee: S.I.M.A.C. S.p.A. (IT)

( * ) Notice: Subject to any disclaimer, the term of this patent is extended or adjusted under 35 U.S.C. 154(b) by 0 days.

(21) Appl. No.: 10/652,478

(22) Filed: Aug. 28, 2003

(65) Prior Publication Data

US 2004/0108631 A1 Jun. 10, 2004

Related U.S. Application Data

(63) Continuation of application No. PCT/IT02/00066, filed on Feb. 5, 2002.

(30) Foreign Application Priority Data

Mar. 8, 2001 (IT) ..... UD01A0048

(51) Int. Cl.[7] ..... C21D 9/54

(52) U.S. Cl. ..... 266/105; 266/276; 72/250; 198/450

(58) Field of Search ..... 266/105, 274, 266/276; 198/614, 450; 72/250, 251

(56) References Cited

U.S. PATENT DOCUMENTS 3,610,437 A 10/1971 Barakov et al. ..... 214/1 P
4,054,047 A * 10/1977 Sclippa ..... 198/450
6,192,729 B1 * 2/2001 Offoiach ..... 72/250

FOREIGN PATENT DOCUMENTS

| | | |
|---|---|---|
| DE | 465 625 | 9/1928 |
| DE | 24 12 642 | 9/1975 |
| FR | 2 419 892 | 10/1979 |
| IT | 1214159 | 1/1990 |
| WO | WO 99/59757 | 11/1999 |

OTHER PUBLICATIONS

Steel Times, "An Italian Supplier Consolidates A Growing Niche", Nov. 1990, pp. 626–627.

* cited by examiner

*Primary Examiner*—Scott Kastler
(74) *Attorney, Agent, or Firm*—St. Onge Steward Johnston & Reens LLC

(57) ABSTRACT

Device for receiving and discharging bars fed forward in a longitudinal direction, preferably from a rolling mill and after being cut to length, of the type with two pair of adjacent, counter-rotating rollers/drums, characterized by the fact that the said bars are sent alternately into a zone immediately above each pair of said drums, which rotate and drag the bar between them in a downwards direction, and which subject the bar to elastic, friction compression in order to slow it down while it is being fed forward and then, continuing their rotation, make the bar fall in a pick-up zone below.

15 Claims, 3 Drawing Sheets

DEVICE AND RESPECTIVE EQUIPMENT FOR RECEIVING AND DISCHARGING BARS, USED PARTICULARLY FOR HANDLING AND/OR WRAPPING PURPOSES DOWNSTREAM OF ROLLING-MILLS, AND ITS RESPECTIVE ROLLING-MILL

This application is a continuation of pending International Patent Application No. PCT/IT02/00066 filed Feb. 5, 2002, which designates the United States and claims priority of pending Italian Application No. UD01A000048 filed Mar. 8, 2001.

FIELD OF THE INVENTION

The object of this patent is a device and respective equipment for receiving and discharging bars, used particularly for handling and/or wrapping purposes downstream of rolling-mills.

The rolling plant that is part of the said device is also part of the invention.

The invention is used particularly, but not exclusively, in hot-rolling plants for the production of bars, and in which the aim is the quick discharge of the rolling-mill.

BACKGROUND OF THE INVENTION

There are a number of alternative systems currently used to discharge bars downstream of a rolling-mill, once they have been cut to length (6/12 m) at an on-the-fly cutting station, also known as a flying shear, which works in conjunction with a deviation device which deviates the bar onto a slow-down and discharge runner or, as an alternative, deviates the successive bar onto a parallel runner adjacent to the first one.

The runner-type devices have a series of devices for stopping the bar upstream of the runner and after the said deviator, which grip the tail of the bar and slow it down when it enters into the runner, in order to halt its longitudinal advancement and to let it be discharged laterally onto equipment for successive treatment, such as a cooling bed, a collecting bag where the bundle of bars is then tied, etc.

A well-known system is described in the Italian Patent Request N° UD98A000085, also presented by SIMAC.

These well-known solutions have limitations regarding their performance and, as stated, and especially in the case of high-speed plants (50 m/sec), need to have devices for slowing the bars down which make the equipment rather complicated, increase its complexity and requires a high amount of maintenance.

The aim of this invention is to overcome the aforementioned drawbacks and to increase the overall performance of the plant.

This and other aims are achieved by applying the invention described.

In this way, thanks to the use of an integrated runner, slow-down and discharge system within one single system, the entire plant is more functional and reliable.

Finally, with this system, by installing an on-line cooling or heat-treatment station, the bars may be bundled together and packed at the exit side of the system without having to go through other cooling systems, such as a cooling bed, or handling and length-cutting means.

This means that the rolling plant is very compact and more economical.

The invention is mainly applied to the production of corrugated iron rods or corrugated bars, but may also be used for other profiles by using special channeling on the counter-facing drums.

These and other advantages will be highlighted in the following detailed description of preferred solutions and relative illustrations, the details of which are to be considered simply examples and not limitations.

DETAILED DESCRIPTION OF DRAWINGS

Figure 4:
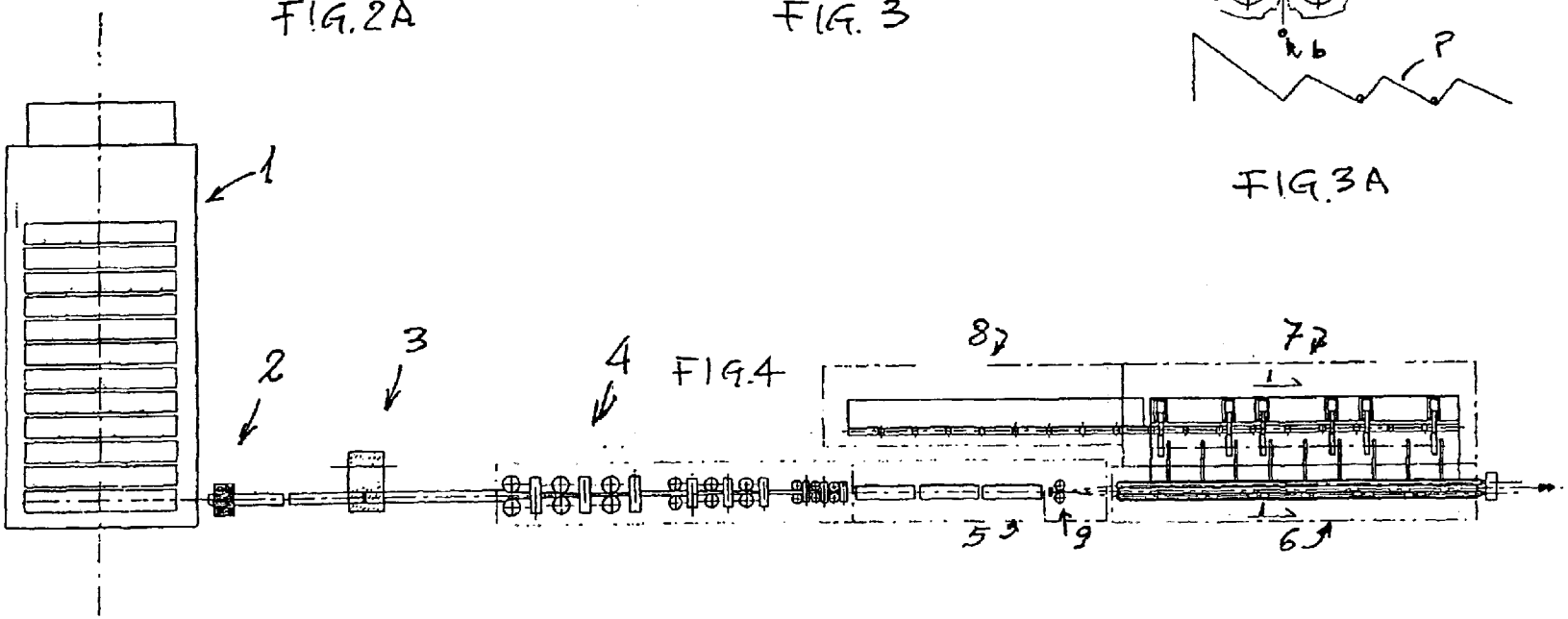
FIG. 4 is a plan view of an optimum layout of a rolling mill and bundling system for bars.

With reference to the figures, and in particular FIG. 4, with 1 is indicated a heating furnace for the billets to be rolled, 2 indicates a de-scaling device, 3 indicates a feeding device for moving the material forward, 4 indicates the vertical and horizontal rolling stands, 5 indicates a cooling tunnel and, if foreseen, heat treatment station, 9 indicates a flying-shear station for cutting the rolled bars to length, 6 is a double-runner system (61) with two pairs of holding, discharge and self-braking rollers/drums (64–64'), 7 is a bundling and binding system and 8 is a storage area or stocking-area.

As illustrated in FIGS. 2, 2A, 3 and 3A, the device contained in this invention includes a double runner for alternated receiving of the bars by means of support 61 which, with pin (hinging) 62 and brackets 63 and 65, support a pair of opposing rotating rollers/drums 64 and 64' which take the bars (b) and stop them by friction. The bars are then discharged downwards onto a cooling bed (P), or onto an extractor with a worm-screw 67, to be discharged onto the bag 711 of a continuous transfer device 71 which, together with binder 72, is part of a bundling and tying station 7.

Figure 1:
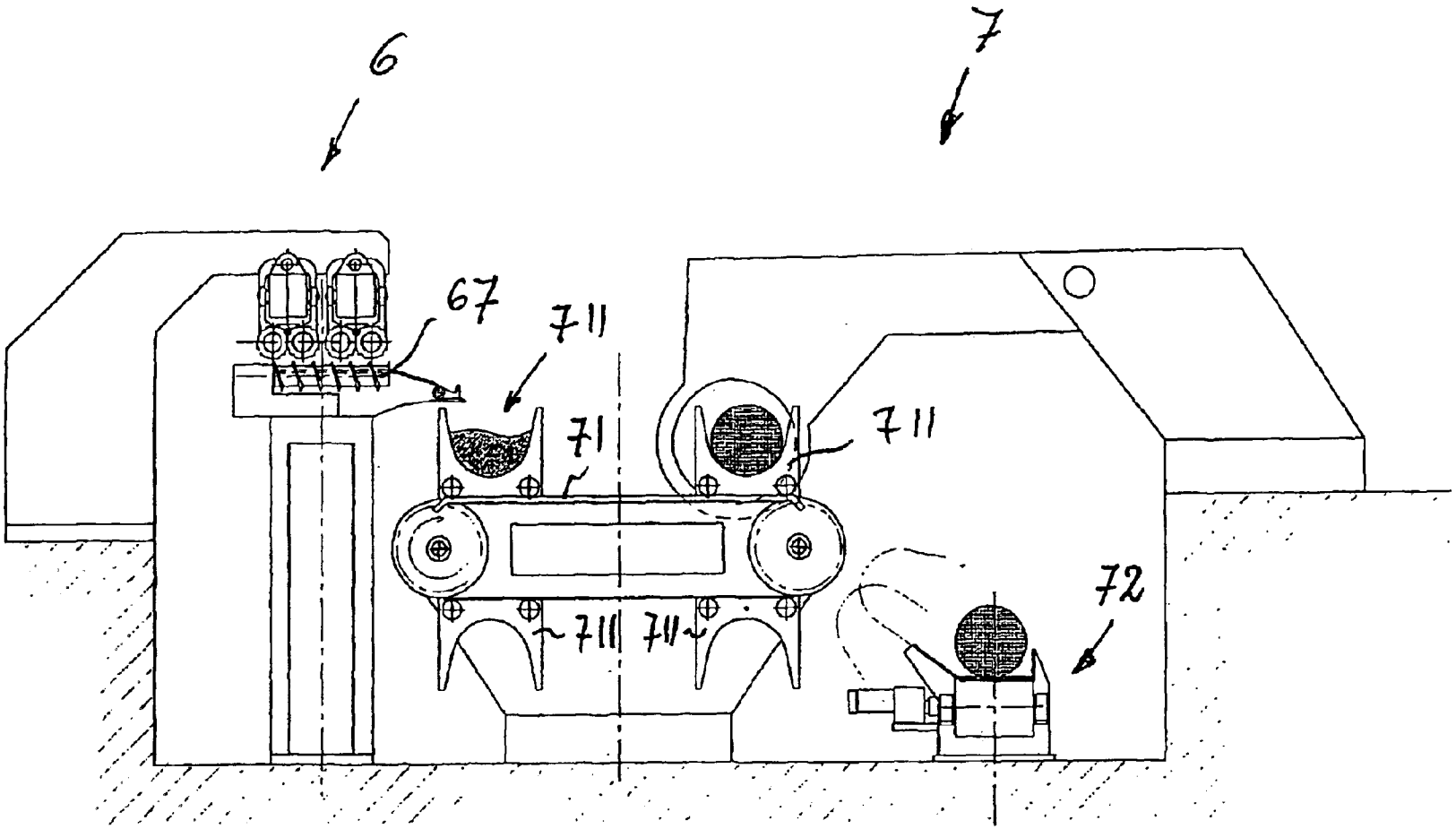
FIG. 1 is a schematic view of a vertical section, which is transversal with respect to the longitudinal axis of the bars, of the slow-down, discharge and wrapping system of the bars, in this case corrugated bars.
Figure 2:
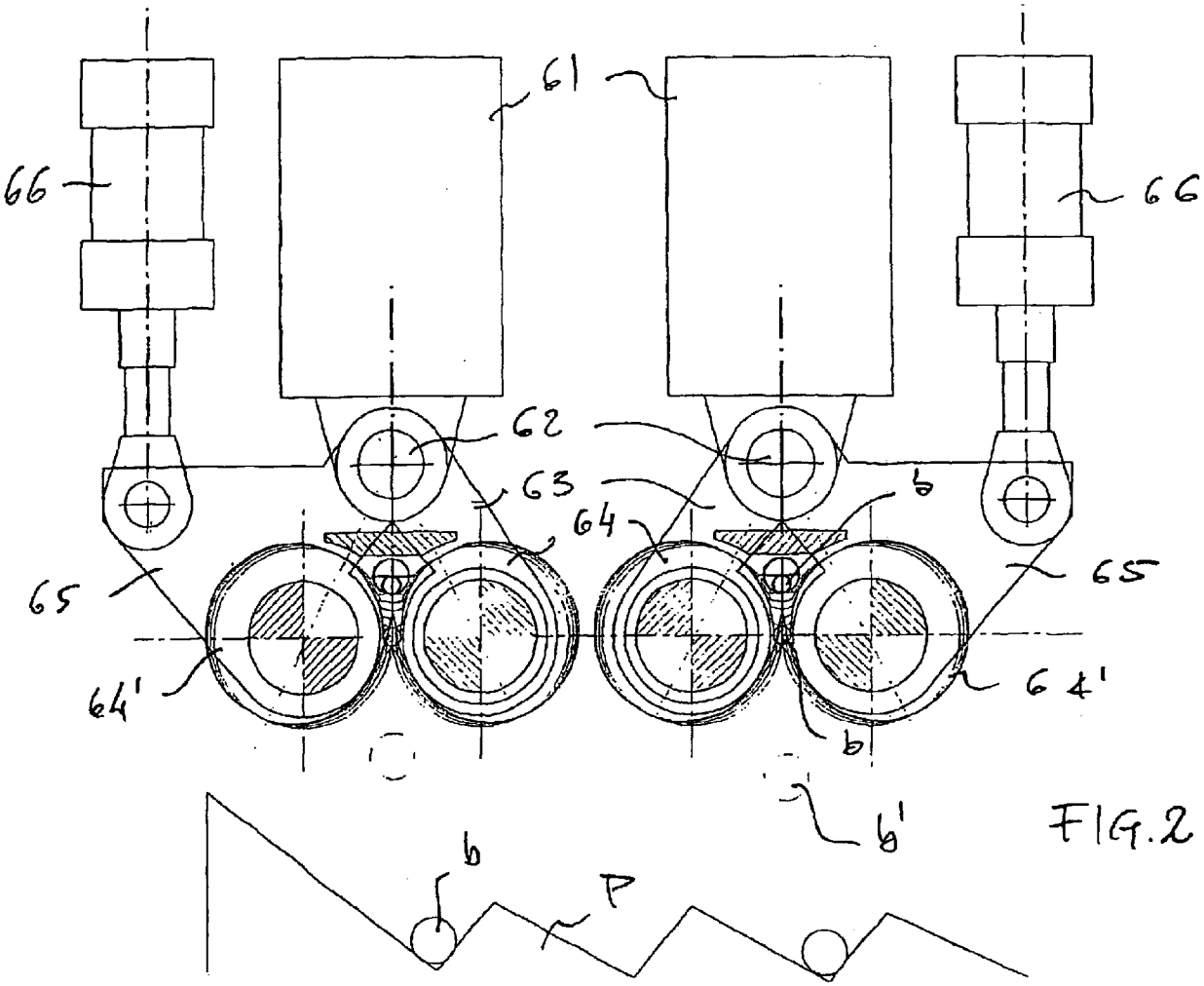
FIGS. 2 and 2A are, respectively, enlarged and reduced schematic, transversal, vertical sectional views of the said slow-down and vertical discharge system, in this case onto a cooling bed, using two pairs of opposing rollers or drums or eccentrics which float against each other.

Since there is a floating movement of the or rollers/drums (65–66) due to external, lateral hydraulic cylinders FIG. 2, 2A, internal, mobile hydraulic cylinders between the support jaws or helicoidal traction springs (FIG. 3), it is possible to hold bars (b') with various diameters.

Figure 3A:
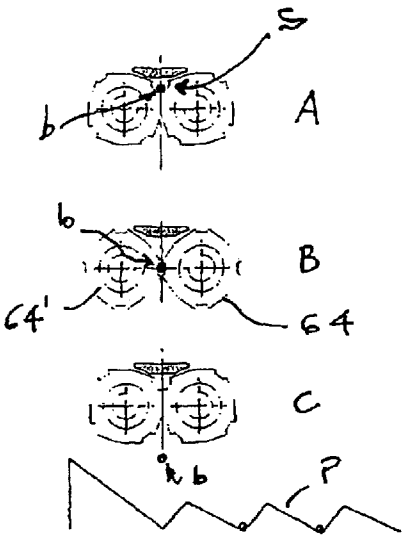
FIG. 3A is a schematic illustration of the discharging of bundles of bars onto an underlying cooling bed, the structure and operation of which is widely used in this sector.

The lowering phases (A, B and C steps) are illustrated in FIG. 3A.

An advantage of the counter-positioned roller/drums (64, 64') is that they may have longitudinal guide channels to collect the bars (64').

In an alternative version, the roller/drums (64, 64') have a smooth surface (rollers).

The rollers/drums (64, 64') may also be eccentric.

Figure 3:
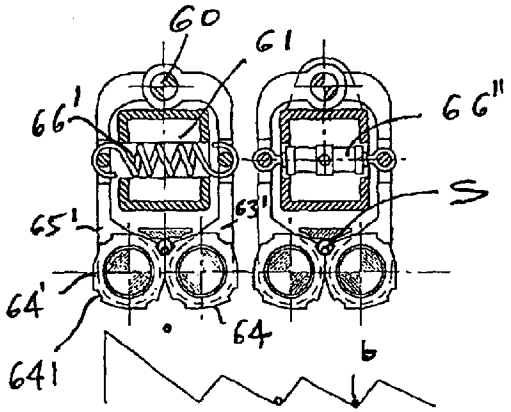
FIG. 3 is a schematic view of a variation to FIG. 2A, showing two different damping systems for the floating movement (elastic-yielding one against the other) of the said rollers/drums, with channels instead of the eccentric form, to control the conveying of the bars better.
Figure 2A:
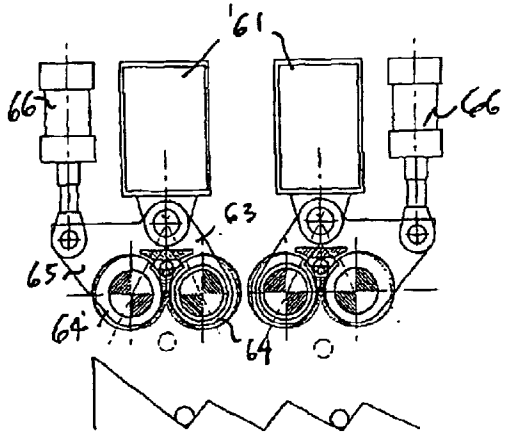

In the solution illustrated in FIG. 2A, the floating (elastic-yielding) movement occurs on the external cylinders only, while in FIG. 3 the movement occurs on both cylinders which are held so as to form opposing jaws (65', 63') around the upper pin (60), while the traction means is through a spring 66' or a hydraulic cylinder 66".

The said cylinders (64, 64') may have either a smooth surface, a knurled surface, a satin-finish surface or a rough surface, according to the specific requirements.

The same may be said for the channels (64), with the eccentricity synchronized according to the rate of the ingress of the bars.

What is claimed is:

1. A device for receiving and discharging bars fed forward in a longitudinal direction, including two pair of adjacent, counter-rotating rollers/drums, characterized by the fact that said rollers/drums are elastically pushed against each other in order to receive the bars sent alternately into a respective zone immediately above each pair of said rollers/drums, which rotate and drag the bar between them in a downwards direction, and which subject the bar to elastic, friction compression in order to slow it down while it is being fed forward and then, continuing their rotation, make the bar fall in a pick-up zone below.

2. A device according to claim 1, characterized by the fact that, below each double pair of rollers/drums, there are a number of transversal rotating mechanisms including worm-screws to convey the bars which drop onto them in a lateral direction.

3. A device according to claim 1, characterized by the fact that the rollers/drums are supported by elastically yielding mechanisms.

4. A device according to claim 3, characterized by the fact that the elastically yielding mechanisms of the rollers drums have a lateral support bracket which oscillates via a double hinge with an external, counteracting hydraulic cylinder.

5. A device according to claim 3, characterized by the fact that the elastically yielding mechanisms of the rollers/drums are mounted on opposing arms to form jaws which are hinged above, and which have intermediate, floating traction elastically yielding mechanisms.

6. A device according to claim 5, characterized by the fact that the said floating, traction elastically yielding mechanisms are formed by helicoidal springs.

7. A device according to claim 6, characterized by the fact that the floating, traction elastically yielding mechanisms are formed by a fluid-operated cylinder.

8. A device according to claim 7, characterized by the fact that the rollers/drums have a smooth surface.

9. A device according to claim 8 characterized by the fact that the rollers/drums have a knurled surface, a satin-finish surface or a rough surface.

10. A device according to claim 9, characterized by the fact that the rollers/drums are eccentric.

11. A device according to claim 1, characterized by the fact that the rollers/drums have guide channels to collect and encase the bars by clamping them.

12. A device according to claim 1, characterized by the fact that it includes worm-screws that discharge the bars into a bag of a continuous transport device which discharges the bars into a binder.

13. A rolling mill which has a device according to claim 1.

14. A rolling mill according to claim 13, characterized by the fact that upstream it also has:

means for pre-heating the material to be rolled;

means for de-scaling the material;

means for feeding the material;

means for rolling the stock material;

on-line cooling means of for cooling the stock rolled material and/or heat treatment means; and means for cutting the stock rolled material to bars of a certain length with an alternated bar deviator immediately above at least one of the pairs of cylinders.

15. A method using a device for receiving and discharging bars fed forward in a longitudinal direction, including two pairs of adjacent, counter-rotating rollers/drums, according to claim 1 characterized by the fact that the bars are sent alternately into a zone immediately above each pair of said drums, which rotate and drag the bar between them in a downwards direction, and which subject the bar to elastic, friction compression in order to slow it down while it is being fed forward and then, continuing their rotation, make the bar fall in a pick-up zone below.

* * * * *